US007238129B2

(12) United States Patent
Mitzak

(10) Patent No.: US 7,238,129 B2
(45) Date of Patent: Jul. 3, 2007

(54) LACROSSE SHOOTING STRING APPARATUS

(76) Inventor: Kevin Michael Mitzak, 19 Marshall Rd., Hillsborough, NJ (US) 08844

( * ) Notice: Subject to any disclaimer, the term of this patent is extended or adjusted under 35 U.S.C. 154(b) by 325 days.

(21) Appl. No.: 11/052,574

(22) Filed: Feb. 8, 2005

(65) Prior Publication Data

US 2005/0148412 A1 Jul. 7, 2005

Related U.S. Application Data

(63) Continuation-in-part of application No. 10/376,101, filed on Mar. 1, 2003, now Pat. No. 6,962,541.

(60) Provisional application No. 60/361,915, filed on Mar. 4, 2002.

(51) Int. Cl.
*A63B 59/02* (2006.01)
*A63B 65/12* (2006.01)

(52) U.S. Cl. ..... 473/513

(58) Field of Classification Search ..... 473/512, 473/513; D21/724
See application file for complete search history.

(56) References Cited

U.S. PATENT DOCUMENTS

| | | | | |
|---|---|---|---|---|
| 4,049,273 | A * | 9/1977 | Pool | 473/513 |
| 4,273,331 | A * | 6/1981 | Fischer | 473/543 |
| 4,458,898 | A * | 7/1984 | Boden | 473/543 |
| 4,460,178 | A * | 7/1984 | Ulman | 473/513 |
| 5,158,286 | A * | 10/1992 | Soong | 473/522 |
| 5,707,306 | A * | 1/1998 | Boden | 473/543 |
| 5,967,912 | A | 10/1999 | Hexemer et al. | |
| 6,066,056 | A | 5/2000 | Morrow | |
| 6,186,912 | B1 | 2/2001 | Gait | |
| 6,213,901 | B1 | 4/2001 | Collinson | |
| 6,447,410 | B2 * | 9/2002 | Crawford | 473/513 |
| RE37,894 | E | 10/2002 | MacNeil | |
| 6,506,132 | B1 | 1/2003 | Brine, III et al. | |
| 6,520,875 | B1 | 2/2003 | Crawford | |
| 6,676,547 | B1 | 1/2004 | Morrow | |
| 6,852,047 | B2 | 2/2005 | Tucker | |
| 6,962,541 | B2 * | 11/2005 | Mitzak | 473/513 |
| 7,070,523 | B1 * | 7/2006 | Gait | 473/513 |
| 2002/0107094 | A1 | 8/2002 | LeMire | |
| 2002/0160865 | A1 | 10/2002 | Brine, III et al. | |
| 2005/0148412 | A1 * | 7/2005 | Mitzak | 473/513 |

* cited by examiner

*Primary Examiner*—Eugene Kim
*Assistant Examiner*—M. Chambers
(74) *Attorney, Agent, or Firm*—Gerald J. Smit

(57) ABSTRACT

A shooting string apparatus used in playing the sport of lacrosse. The apparatus is located in the head of a lacrosse stick during the play of the game of lacrosse. During lacrosse play, a player may find it advantageous to use this invention in the making of easy and rapid adjustments to the tensions of the webbing in the area of shooting string apparatus. There may be one or several shooting string apparatus in use simultaneously. In this invention, the shooting string apparatus is constructed with a flat central piece called the shooting string section. Affixed to the shooting section are a series of flaps or opposed flaps that fold over and hold the shooting string in place within the stick head. A tension string may be encompassed by but does not attach to and does not extend internally through the shooting string section. The shooting string section does not itself exert tension on the webbing. The shooting string apparatus of this invention can be quickly and easily moved from one stick head to another.

6 Claims, 1 Drawing Sheet

LACROSSE SHOOTING STRING APPARATUS

CROSS-REFERENCES TO RELATED APPLICATIONS

This application is a Continuation in Part of U.S. Utility Application No. 10/376,101 filed Mar. 1, 2003 now U.S. Pat. No. 6,962,541 and also claims the benefit of the filing date of U.S. Provisional Application No. 60/361,915, filed Mar. 4, 2002 and both applications are hereby incorporated by reference in their entirety and included herein as if set forth at length.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

FIELD OF THE INVENTION

This invention relates to lacrosse stick head flexible elements and their adjustment.

BACKGROUND OF THE INVENTION

This invention is used in the sport of lacrosse, which is considered the oldest team contact sport of North America. The sport of lacrosse is played with sticks used for catching, carrying, and throwing a ball into the opposing team's goal. Lacrosse sticks have a handle and a head. The head of the stick is a frame. Strung across the head frame with varying degrees of looseness and tension are flexible elements such as strings, thongs and/or netting material. Within the head frame, the thongs and/or netting material are typically strung either traditionally (a complex pattern of leather and nylon strings woven together) or in mesh (a piece of mesh material attached to the head by nylon strings) to create what is known as a pocket. According to the jargon of the sport, a ball in play will be held in the pocket. The pocket is an area of slack in the flexible elements. And the determining factors as to how each individual pocket throws (the degree up or down out of the pocket when the ball is released) is the friction imparted by the shooting strings and the tension of the web elements in the location of the shooting strings.

In the lexicon of the sport, the word "tension" does not carry the meaning that an engineer would use in the sense of a force being applied. Rather, players of the sport use the word "tension" to identify the amount of slack or excess length in a flexible element. The greater the tension means the less excess slack in comparison to the slack in the other flexible elements. Similarly the word "friction" as used by players has a meaning relating to ball release characteristics and not just the strict engineering term of resistance to relative motion between two bodies in contact.

In the act of throwing or shooting, the lacrosse stick is swung in an arc and the ball, which is initially located around the center of the pocket, begins to travel away from the center of the arc out of the pocket due to centrifugal force. While the ball is accelerating out of the pocket, it remains in constant contact with the pocket and the forces exerted when the ball passes over the shooting strings and the angle created by the shooting strings determines the degree up or down the ball will travel once released from the pocket. The greater the tension of the shooting strings, the greater the downward angle the ball will follow after hitting the strings. The lesser the tension, the greater the upward angle the ball will follow since there is not as much rebound surface redirecting it down. Similarly the friction of the playing ball surface in contact with the shooting strings and flexible elements of the stick head will also control the angle of ball release.

Most players of the sport use more than one shooting string in their stick head pocket. The reason for this is to provide a more fluent release from the stick head pocket. This is achieved by staggering the differences in tension throughout multiple shooting strings, where the first shooting string with which the ball comes in contact contains the least amount of tension among the shooting strings, and the amount of tension becomes gradually greater with each shooting string with which the ball comes in contact. This eliminates the abrupt release experienced when there is only one shooting string and the ball experiences a great amount of friction and tension all at once instead of small amounts of friction and tension gradually. A small amount of friction and tension gradually creates a smooth, fluid release most players of the sport prefer. However, every player is different and has his/her own personal preference as to how the ball is released from their pocket, so best release option, whether a smooth, gradual release or a hard, abrupt release remains up to each individual players taste. It is very difficult to create the perfect tension for your style of throwing/shooting, and even when the perfect tension is found, it is extremely difficult to maintain that tension over long periods of time.

Until now, the shooting string has been nothing more than continuous common string-like material with perhaps expansions in the string as identified by the prior invention of the inventor herein. Typically, the string was intricately interwoven into the pocket, and wound over itself repeatedly. This is not only very difficult, but creates the problem of permanence, making it extremely hard to add and remove the strings. In inserting or adjusting a shooting string, the degree of tension had to be guesstimated by hand, and, when the appropriate degree of tension was thought to be found, the string had to be interwoven and wound over itself repeatedly by using both hands while simultaneously holding the stick with some other part of the body, hoping to not have altered the tension in the process. The problem here is that since the player is guesstimating the tension, it becomes a trial and error process to find the perfect tension. In addition, once the player finds the perfect tension, it takes only weeks, days, and sometimes even hours before the tension changes causing wild throws.

There are many different reasons causing the change in tension. The main reason would probably be due to the weather. Lacrosse is an outdoor sport so the lacrosse sticks are exposed to nearly all forms of natural elements. The most common element would have to be rain. When the shooting strings become wet, they expand in size and are more susceptible to be stretched when force is applied to them. While playing the game of lacrosse, each player must catch and throw the ball numerous times. Each time these actions are performed, force is applied to the shooting strings casing them to stretch. Lesser but more frequent forces are created by the mere swinging of the stick. Conversely, exposure to heat, rising temperatures, and sunlight may cause the string to shrink. Once this happens, the tension in the shooting strings becomes distorted causing the ball to be released from the sticks pocket differently, ultimately resulting in throws/shots being very off target to no fault of the player, but by fault of the shooting strings.

Because the strings are intricately interwoven into the pocket and wound over itself repeatedly, there is a great length of string being used. Even a small percentage change in length can cause a multiplicative change in tension. Players use of a great deal of interwoven and wound over itself string in order to obtain bulk and friction in the pocket that will change the release angle.

When the shooting strings stretch or shrink, it is a very unpleasant process to correct this problem. If this should happen during a practice, a player is forced to call a timeout and be replaced. The player must go to the sideline and attempt many various tensions until the player finally finds the appropriate tension. Meanwhile, the player is missing practice.

Although the practice situation of shrunken or stretched strings is annoying, it may just be the best case scenario for a player's shooting strings to fail. For example, imagine playing in a championship game and with your team down by one with only seconds left in the game. The wear and tear of a full game's worth of applied forces to your shooting strings and varying weather conditions has caused the tension to change without your knowing it. The shooting string tensions have changed dramatically just as you become open mere feet in front of the opposition's goalkeeper. Your teammate delivers a perfect pass to you with three seconds left on the clock giving you the perfect opportunity to tie the game and send it into overtime. You wind up and deliver your shot; and you can see in your mind's eye the ball entering the goal before you even release it. Then, to your horror, you see the ball sailing away, completely off line from its intended target. Your heart drops as you realize what must have happened as you watch your shot travel into the parking lot and the opposition begins to celebrate. You blew it, or should I say, your shooting strings blew it. There is no worse feeling than wondering if that shot would have scored if your shooting strings had remained at the tension you were used to, the tension you were expecting when you took that final shot.

BRIEF SUMMARY OF THE INVENTION

The present invention pertains to in the sport of lacrosse. The present invention overcomes most of the problems of the prior art enumerated above.

The invention enables the use of a relatively short length of tension element while providing bulk in the form of the shooting string material for friction purposes and allowing for fine, continuous, and rapid adjustment of the shooting string tension. Using a shorter length of tension string than common in the prior art serves to mitigate the unpredictable but multiplicative tension effects due to the rigors of lacrosse play. The rigors of lacrosse play are the weather, vibration, and impact forces causing the stretching and shrinking effects that change the tension. The invention also allows for rapid removal and replacement with a new shooting string apparatus. Specifically, this invention relates to a material that is shaped and configured into a shooting string section for rapid attachment to the thongs and/or netting material on the heads of the sticks to achieve the purposes of the traditionally configured stick head shooting string. With the use of the invented shooting string section, the shooting string tension may be easily and rapidly adjusted. The proposed stick head shooting string sections provide a capability to more accurately and controllably launch a ball over an extended period of time at a target location due to the ability to repeatedly and easily refine the equipment settings. The shooting string section may also be used on sticks that have no tension elements.

The new invention achieves the following: simplifies the adjusting of the shooting string tension; provides the bulk of the traditional shooting string for friction purposes; allows tension adjustments to be more rapidly refined, accurate and permanent; and enables the shooting string equivalent to be switched from one stick to another stick quickly and easily. As the invention also provides for apparatus that may be easily transferred between sticks, it may appeal to the cost conscious player or a player with a limited budget.

An object of the invention is to allow for rapid, fine, and continuous adjustment of the shooting string section tension to counteract the tendency of the flexible elements of head of a lacrosse stick to loose tuning. The invention also allows for gradual changes to the shape of the lacrosse stick pocket in response to playing conditions or the skill or tactics of the immediate opponent. The changes may be made even during the course of play, a heretofore unthinkable activity.

A further objective of this invention is to provide a shooting string that is easier to install and tune than the shooting strings of the prior art. The ability to easily add or remove shooting strings by merely releasing tabs possesses many advantages over interweaving or removing the interweaving of additional thongs, strings or other flexible elements.

To improve the wear ability of the shooting string section, reinforcement may be added to the general flap area. The reinforcement may be built up to strengthen the underlying shooting string material. In one preferred embodiment, the reinforcement is in the form of a coating deposited on the general flap area. The reinforcement aids in securing the flaps to the shooting string section and fortifies the flap interlocking arrangement areas.

This invention is distinguished from the teachings in the APPARATUS FOR A LACROSSE STICK HEAD application Ser. No. 10/376,101, a prior invention of Kevin Michael Mitzak who is also the inventor herein, in that the shooting string sections of the earlier invention required the tension element to either be internal to the unfastened shooting string section or physically attached the shooting string section, such as tied to the ends of the shooting string section. The prior application Ser. No. 10/376,101 did not teach the feature of the present invention that the shooting string section may float independent of the tension element. The prior application Ser. No. 10/376,101 did not teach the feature of the present invention that the shooting string section may be loosely located in relation to the tension element. The prior application Ser. No. 10/376,101 did not teach the feature of the present invention that the shooting string section may be removed from the lacrosse stick head while the tension element remains attached to either or both the lacrosse stick head and the tension element tension adjustment mechanism. This last feature of rapid removal from the stick head while the tension element and adjustment mechanism remain in place provides for easy transferability of the shooting string section among different lacrosse sticks. Conveniently changing shooting string sections among sticks is important to some players. The prior application Ser. No. 10/376,101 taught that either tension element physical attachment or that significant friction with the tension element due to internal proximity within the shooting string section was necessary. These constraint characteristics have now been discovered to be less desirable than the characteristics of the present invention. In contrast, one of the features of the present invention is that the shooting string section may float independent of and be physically separated from the tension element. In the invention of the prior application Ser. No. 10/376,101, the shooting string material acted as an enlargement of the tension element with the forces of the tension element extending directly through the shooting string section. In contrast, the present invention is not held or frictionally constrained by the forces of the tension element, but rather is free to move so as to impart on the ball a less abrupt change in trajectory. The present invention provides more resilience in ball release than the prior art inventions.

BRIEF DESCRIPTION OF THE SEVERAL VIEWS OF THE DRAWING

Note: Figures are not to scale.

DETAILED DESCRIPTION OF THE PREFERRED EMBODIMENTS OF THE INVENTION

Figure 1:
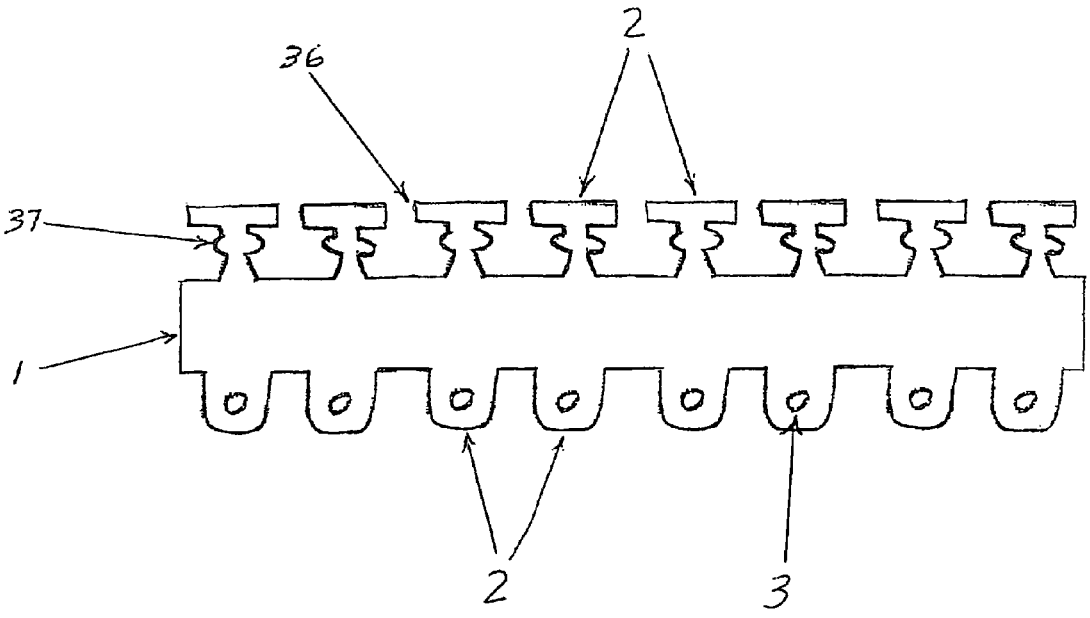
FIG. 1 is the shooting string section with the flaps open. This is the view of the shooting string section with one particular flap configuration before the shooting string section is fastened into the stick head.

FIG. 1 shows an embodiment of the shooting string section 1 before it is fastened into the stick head. In this embodiment shooting string section 1 is placed on at least one of the flexible elements and the flaps 2 are partially or totally wrapped around the flexible elements of the shooting sting area. The shooting string section 1 is not interwoven with the flexible elements as none of the flexible elements pass in front of the shooting string section 1. Any fastening means may be used to connect the flaps 2 together to constrain the shooting string section 1 against the shooting string area flexible elements. In one preferred embodiment, the means to connect the flaps 2 together is by the use of the flap end projections 36. Each flap end projection 36 is inserted through the hole, also named channel 3, in the opposing flap 2 and the flap end projections 36 serve to hold the shooting string section flaps 2 together. In one preferred embodiment, flap center projections 37 reside on the body of each flap 2. The flap center projections 37 prevent the flap channels 3 from sliding along the flap 2 when the string section is in loose proximate contact with the flexible elements of the stick head. According to the length of the flaps 2 chosen for a particular embodiment, the shooting string section 1 may be held in tight constraint to the flexible elements of stick head or the shooting string section 1 may be loosely held. If the flap 2 lengths are short, the flaps 2 will hold the shooting sting section 1 in tight constraint. If the flap 2 lengths are long, the flaps 2 will hold the shooting string section 1 in loose constraint to the flexible elements of stick head and tension element. The tension element would be contained within the axial string of openings created by the row of joined opposing flaps 2. In this FIG. 1, the shooting string section 1 is shown with the flaps 2 spread open. This is the view of the shooting string section 1 with the flaps 2 in spread position before the shooting string section 1 is fastened into the stick head. The flexible element, thongs or netting material of the stick head is not shown. In this figure, the various elements are displayed close to, but not in exact, relative scale with each other. This presentation of FIG. 1 is called the front face view and it is the mirror image of the back face view. In one embodiment of the invention, the flaps 2 are made more rugged to withstand the rigors of lacrosse play by adding reinforcing layers to the flap 2 area of the shooting string section 1. One way of adding this reinforcing is by coating or depositing a layer of material onto and adjacent to the flap 2 areas of the shooting string section 1. Alternative preferred embodiments of shooting string sections 1 made using the materials of natural and synthetic rubbers have been found to perform satisfactorily.

Although FIG. 1 displays a shooting string section 1 with opposed rows of flaps 2 along its length, in one preferred embodiment the flaps 2 extended along only one side of the length. In this embodiment the flaps 2 are long enough to extend around the stick head flexible element and the tension element and the flaps 2 removeably fasten directly to the shooting string section 1.

What is claimed is:

1. A shooting string apparatus for a sports stick, comprising, for use in a lacrosse stick head provided with a top portion component and a base portion component interconnected by a pair of side wall components having an opening within the foresaid head components with flexible elements strung in the opening as a part of a lacrosse stick that is held by a lacrosse player's hands during lacrosse play, a shooting string section with a length dimension greater than the width dimension, wherein the shooting string section further comprises multiple flaps along at least one side of the length dimension of the shooting string section, with the flaps extending out in the width dimension to such a length so as to fold at least one-third over at least one of the flexible elements and thereby holding the shooting string section in constrained proximity to at least one of the flexible elements; wherein the flaps are shaped to interlock with the shooting string section and resist releasing under the rigors of lacrosse play.

2. The shooting string section of claim 1 comprising multiple flaps along each side of the length dimension of the shooting string section.

3. The shooting string section of claim 1 wherein the flaps are shaped to interlock with each other and resist releasing under the tensions of lacrosse play.

4. The shooting string section of claim 1 wherein the shooting string section material is selected from a group comprising natural and synthetic rubber products.

5. The shooting string section of claim 1 wherein part of the shooting string section is reinforced for added strength.

6. The shooting string section of claim 5 wherein said part of the shooting string section is a deposited coating material.

* * * * *